US008525448B2

(12) United States Patent
Tanaka et al.

(10) Patent No.: US 8,525,448 B2
(45) Date of Patent: Sep. 3, 2013

(54) CIRCULAR ACCELERATOR AND OPERATING METHOD THEREFOR

(75) Inventors: Hirofumi Tanaka, Tokyo (JP); Kazuo Yamamoto, Tokyo (JP); Nobuyuki Haruna, Tokyo (JP); Yuehu Pu, Tokyo (JP); Kanji Shinkawa, Tokyo (JP); Takayuki Kashima, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 0 days.

(21) Appl. No.: 13/368,435

(22) Filed: Feb. 8, 2012

(65) Prior Publication Data

US 2012/0217903 A1 Aug. 30, 2012

(30) Foreign Application Priority Data

Feb. 28, 2011 (JP) ..... 2011-041742
Nov. 8, 2011 (JP) ..... 2011-244298

(51) Int. Cl.
*H05H 13/00* (2006.01)

(52) U.S. Cl.
USPC ..... 315/502; 315/500; 315/501; 315/507; 328/235; 328/236; 250/396 R

(58) Field of Classification Search
USPC .. 315/500–507; 335/216, 299; 250/396 ML, 250/298, 400, 492; 328/233, 235, 228–230; 313/62
See application file for complete search history.

(56) References Cited

U.S. PATENT DOCUMENTS

| | | | | |
|---|---|---|---|---|
| 4,996,496 | A * | 2/1991 | Kitamura et al. | 315/501 |
| 5,436,537 | A * | 7/1995 | Hiramoto et al. | 315/507 |
| 5,521,469 | A * | 5/1996 | Laisne | 315/502 |
| 6,057,655 | A * | 5/2000 | Jongen | 315/502 |
| 7,402,963 | B2 * | 7/2008 | Sliski et al. | 315/502 |
| 7,541,905 | B2 * | 6/2009 | Antaya | 335/216 |
| 7,656,258 | B1 * | 2/2010 | Antaya et al. | 335/216 |
| 8,207,656 | B2 * | 6/2012 | Baumgartner et al. | 313/62 |
| 2012/0013274 | A1 * | 1/2012 | Bertozzi et al. | 315/504 |

FOREIGN PATENT DOCUMENTS

| | | | |
|---|---|---|---|
| WO | WO 91/07864 | A1 | 5/1991 |
| WO | WO 2006/012467 | A2 | 2/2006 |
| WO | WO 2007/084701 | A1 | 7/2007 |
| WO | WO 2007/130164 | A2 | 11/2007 |

* cited by examiner

*Primary Examiner* — Daniel Cavallari
*Assistant Examiner* — Srinivas Sathiraju
(74) *Attorney, Agent, or Firm* — Buchanan Ingersoll & Rooney PC

(57) ABSTRACT

The circular accelerator comprises: a bending electromagnet that generates a bending magnetic field; a radio-frequency power source that generates a radio-frequency electric field in accordance with an orbital frequency of charged particles; a radio-frequency electromagnetic field coupling part connected to the radio-frequency power source; an acceleration electrode connected to the radio-frequency electromagnetic field coupling part; and an acceleration-electrode-opposing ground plate provided to form an acceleration gap between the plate itself and the acceleration electrode, for generating the radio-frequency electromagnetic field in an orbiting direction of the charged particles; wherein the bending electromagnet generates the bending magnetic field varying in such a way that the orbital frequency of the charged particles varies in a variation range of 0.7% to 24.7% with respect to an orbital frequency at the charged-particles' extraction portion, during a time of injection to extraction of the particles.

19 Claims, 16 Drawing Sheets

CIRCULAR ACCELERATOR AND OPERATING METHOD THEREFOR

BACKGROUND OF THE INVENTION

1. Field of the Invention

The present invention relates to a circular accelerator that accelerates charged particles to high energy while making them orbit along a near-circular spiral orbit, and extracts the accelerated charged particles to the outside thereof.

2. Description of the Related Art

A synchrocyclotron and cyclotron are known as the device that accelerates charged particles to high energy while making them orbit along a spiral orbit. In order to stably accelerate the charged particles in those synchrocyclotron and cyclotron, the following are required: A predetermined radio-frequency acceleration electric field is applied in a beam-traveling direction in accordance with the timing of the particles crossing an acceleration electrode. Predetermined converging force is provided in the beam-traveling direction and also in a direction perpendicular to the beam.

In a synchrocyclotron as described in Patent Document 1, for example, charged particles produced in an ion source are gradually accelerated every time they cross its acceleration electrode while forming an orbit by a bending electromagnet. The radius of the orbit grows larger as their energy increases, that is, the orbit becomes a spiral, and when accelerated to reach their maximum energy, the charged particles are extracted from an extraction duct to the outside. The synchrocyclotron described in Patent Document 1 is configured in a way as follows:

(1) The resonant frequency of an acceleration electrode portion is modulated at high speed with a period of some 1 kHz during acceleration, so as to accelerate the particles by the radio-frequency acceleration electric field frequency-modulated at high speed.
(2) Converging force in a beam traveling direction is secured.
(3) Converging force in a direction perpendicular to the beam can be secured owing to the weak converging magnetic field.

High-speed modulation of the resonant frequency at a 1 kHz level is extremely difficult in the device described in Patent Document 1.

In a cyclotron as described in Patent Document 2, for example, charged particles generated in an ion source are gradually accelerated every time they cross its acceleration electrode while forming an orbit by a bending magnetic field generated by a bending electromagnet. The radius of the orbit grows larger as the charged particles are accelerated to increase their energy, that is, the orbit becomes a spiral orbit, and when the charged particles are accelerated to reach their maximum energy, they are extracted from an extraction duct to the outside. These operations are so far the same as those of the synchrocyclotron.

In order to stably accelerate the charged particles in the cyclotron, (4) A predetermined radio-frequency acceleration electric field is applied in a beam traveling direction, at the timing of the charged particles crossing the acceleration electrode.
(5) Predetermined converging force is provided in a direction perpendicular to the beam.

are required, and in addition, (6) No converging force is provided in the beam traveling direction.

In the cyclotron described in Patent Document 2, regarding the above (4), since magnetic field distribution by the bending electromagnet is formed in such a way that the orbital frequency of the charged particles does not vary depending on acceleration, the frequency of the radio-frequency acceleration electric field does not need to be modulated. This magnetic field is referred to as an isochronous magnetic field. In terms of the above (6), since no converging force is provided in the beam traveling direction in the isochronous magnetic field, the cyclotron is configured in a way such that accuracy of shaping the magnetic field by the electromagnet is raised up to some $1\times10^{-6}$, and in addition, the acceleration voltage is increased so as to extract the beam after turning several hundred times or so. Moreover in terms of (5), in order to generate the isochronous magnetic field, the magnetic field needs to become stronger as the radius increases, which causes large diverging force in the beam perpendicular direction. In order to overcome this diverging force and obtain converging force in the perpendicular direction, the bending electromagnet is configured with a large magnetic pole gap and a small magnetic pole gap repeated alternately in an orbiting direction of the charged particles, and in addition, magnetic poles are shaped in a spiral.

Patent Document 1: International Patent Publication WO2006/012467

Patent Document 2: International Patent Publication WO91/07864

Problems with the conventional circular accelerators have been as follows: Both the synchrocyclotron in Patent Document 1 and cyclotron in Patent Document 2 can hardly Vary acceleration energy by one accelerator to accelerate to a several hundred MeV level so that they can be used for particle beam therapy. Moreover, in the synchrocyclotron in Patent Document 1, high-speed modulation of the resonant frequency of the radio-frequency acceleration electrode portion is needed during acceleration, and since the portion to which high power is supplied is driven at as high speed as 1 kHz, it is difficult to secure reliability. On the other hand, in the cyclotron in Patent Document 2, required accuracy of the magnetic field by the electromagnet must be some $\Delta B/B=1\times10^{-6}$, which therefore needs troublesome work such that magnetic field measurement and machining the magnetic poles are alternately repeated at the site where it is actually installed, so as to realize the foregoing accuracy.

SUMMARY OF THE INVENTION

The present invention has been made to resolve the foregoing problems, and aims at providing a reliable circular accelerator that can easily vary acceleration energy using one accelerator, and does not need to vary the resonant frequency of the radio-frequency acceleration electrode portion during acceleration.

A circular accelerator according to the present invention comprises: a bending electromagnet that is excited by an exciting coil and thereby forms a bending magnetic field, with an electromagnet hill for creating a narrow magnetic pole gap and an electromagnet valley for creating a wide magnetic pole gap alternately disposed in an orbiting direction of charged particles; a radio-frequency power source that generates a radio-frequency electric field in accordance with an orbital frequency of the charged particles; a radio-frequency electromagnetic field coupling part connected to the radio-frequency power source; an acceleration electrode connected to the radio-frequency electromagnetic field coupling part; and an acceleration-electrode-opposing ground plate provided to form an acceleration gap between the plate itself and the acceleration electrode, for generating the radio-frequency electromagnetic field in the orbiting direction of the charged particles; wherein the bending electromagnet generates the bending magnetic field varying in such a way that the orbital frequency of the charged particles varies in a variation range of 0.7% to 24.7% with respect to an orbital frequency at the charged-particles' extraction portion, during a time of injection to extraction of the particles.

According to the present invention, a circular accelerator can be provided in which not only acceleration energy can be varied by one accelerator, but also the resonant frequency of the radio-frequency acceleration electrode portion does not need to be varied during acceleration.

The foregoing and other object, features, aspects and advantages of the present invention will become more apparent from the following detailed description of the present invention when taken in conjunction with the accompanying drawings.

DETAILED DESCRIPTION OF THE PREFERRED EMBODIMENTS

Embodiment 1

Figure 1:
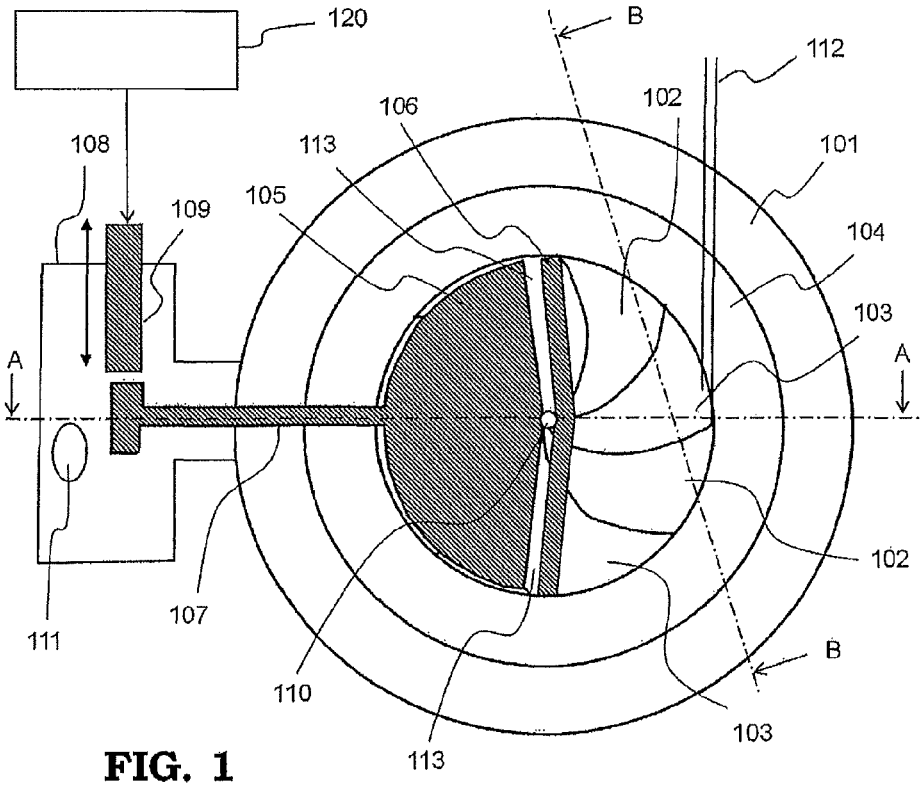
FIG. 1 is a schematic cross-sectional view showing a general configuration of a circular accelerator according to Embodiment 1 of the present invention.
Figure 2:
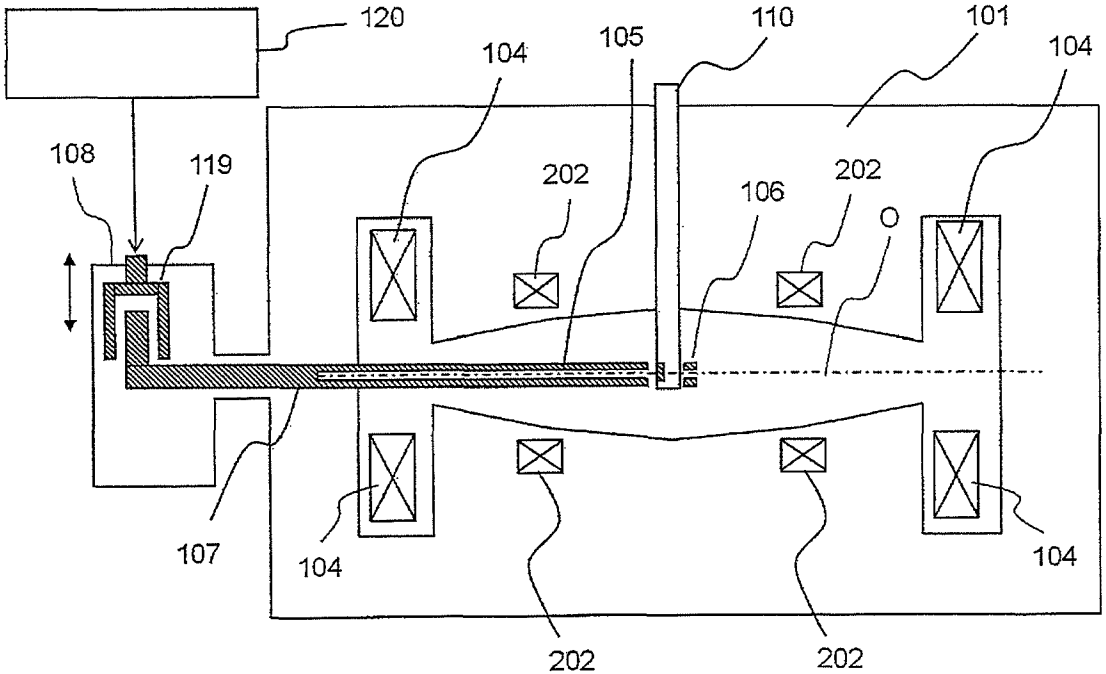
FIG. 2 is a schematic side cross-sectional view along the line A-A in FIG. 1, showing the general configuration of the circular accelerator according to Embodiment 1 of the invention.
Figure 3:
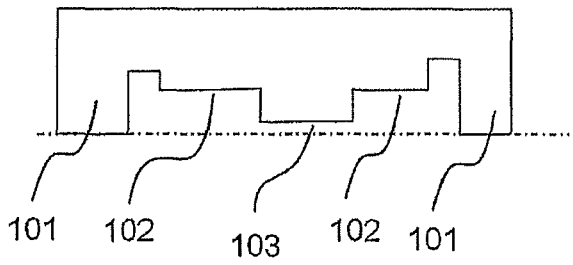
FIG. 3 is a side cross-sectional view along the line B-B in FIG. 1, showing only the upper half of the configuration of an electromagnet.

FIG. 1 is a schematic cross-sectional view showing a general configuration of a circular accelerator according to Embodiment 1 of the present invention. FIG. 1 shows device arrangement in a cross-section cut along an orbital plane in which charged particles orbit. Moreover, FIG. 2 is a schematic side cross-sectional view along the line A-A in FIG. 1. Furthermore, FIG. 3 is a side cross-sectional view along the line B-B in FIG. 1, which shows only the upper half of the configuration of an electromagnet. The configuration and operation of the circular accelerator according to Embodiment 1 of the invention will be described referring to FIG. 1 to FIG. 3.

A bending electromagnet includes an electromagnet return yoke 101, electromagnet valleys 102 each forming a wide magnetic pole gap, electromagnet hills 103 each forming a narrow magnetic pole gap, and an exciting coil 104, by which a bending magnetic field is formed in a direction perpendicular to this sheet including FIG. 1. An orbit for charged particles generated by an ion source 110 is formed by the bending magnetic field. An orbital plane O including the orbit is represented by the dashed dotted line in FIG. 2. Moreover, a radio-frequency wave is supplied from a radio-frequency power source 120 by way of a radio-frequency electromagnetic field coupling part 108, and thereby a radio-frequency acceleration electric field is applied across an acceleration gap 113 formed between an acceleration electrode (dee) 105 and an acceleration-electrode-opposing ground plate (dummy dee) 106. The charged particles are gradually accelerated by this acceleration electric field every time they cross the acceleration gap 113. The orbit of the charged particles grows larger in radius every time they are accelerated, that is, the orbit becomes a spiral orbit, and the accelerated charged particles are eventually extracted from an extraction duct 112 to outside the accelerator. Incidentally, the anode and ion extraction window of the ion source 110 become worn out through longtime use, the ion source 110 is constructed to be able to be taken out of the accelerator for maintenance.

As will be appreciated from FIG. 1 and FIG. 3, the charged particles cross alternately the electromagnet valleys 102 whose electromagnet is thin and magnetic pole gap is wide and the electromagnet hills 103 whose electromagnet is thick and magnetic pole gap is narrow. Thereby, the charged particles are provided with converging force in a direction perpendicular to the particle beam. In order to obtain enough converging force in the perpendicular direction, the electromagnet hills 103 are preferably shaped into a spiral as shown in FIG. 1. By shaping into a spiral, the traveling direction of the charged particles forms an angle with respect to edge portions of the magnetic poles; therefore the charged particles can be provided with predetermined converging force in the perpendicular direction when the particles cross there.

Moreover, as shown in FIG. 2, magnetic pole gaps are narrowed as a whole as the orbiting radius of the charged particles increases, that is, the particles move toward the outer circumference, whereby magnetic field distribution is realized in which the larger the orbiting radius of the charged particles, the higher the magnetic field intensity. Moreover, average magnetic field intensity can also be increased by, for example, widening the angle that the electromagnet hills 103 occupy (sector angle), in accordance with the radius increase.

Figure 4:
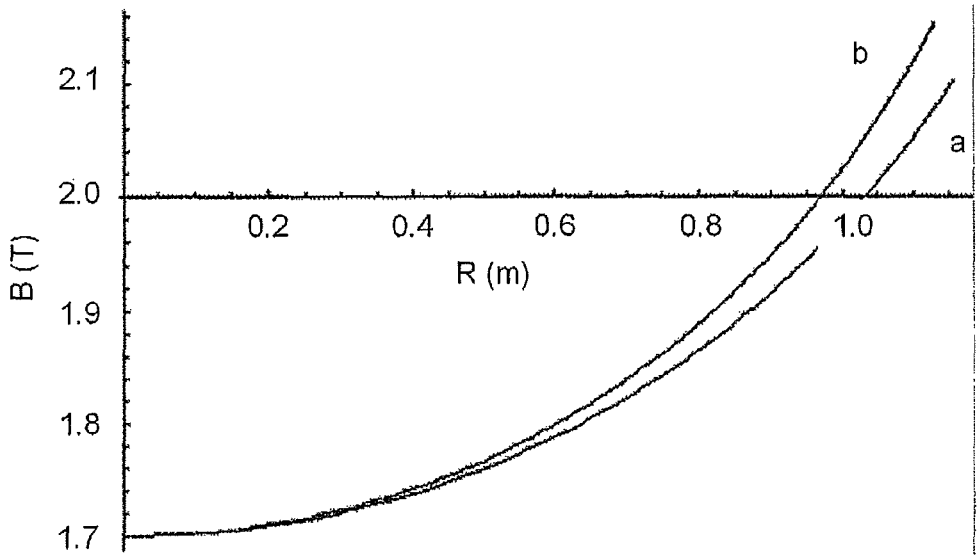
FIG. 4 is a diagram showing an example of magnetic field distribution in the circular accelerator according to Embodiment 1 of the invention.

FIG. 4 shows radial average magnetic flux density distribution necessary for accelerating protons to 230 MeV. In FIG. 4, the horizontal axis represents the radius R(m); the vertical axis, the bending magnetic field intensity (magnetic flux density) B(T). Here, the average magnetic flux density means average magnetic flux density over one full cycle at a position with a given radius. The curve represented by a in FIG. 4 is the magnetic field distribution of the present invention. For comparison, a typical magnetic field distribution of a conventional cyclotron as described in Patent Document 2, etc. is represented by the curve b.

In this invention, the average magnetic flux density B(r) at a position with a radius r in an acceleration region is made to become magnetic field distribution expressed by the following equation (1).

$$B(r)=(B_0/E_0^x)\times E(r)^x \quad (1)$$

where E(r) represents total energy at the position of the radius r; x, a constant excluding 1; and suffix 0, B and E at a given position. For example, $B_0$ and $E_0$ represent the average magnetic flux density and total energy of the particles at the radius corresponding to the extraction position (the outermost circumference of the spiral orbit), respectively.

The curve a in FIG. 4 represents the magnetic field distribution when x=0.9. Incidentally, the curve b representing the typical magnetic field distribution of the conventional cyclotron corresponds to that when x=1 in the equation (1).

Figure 5:
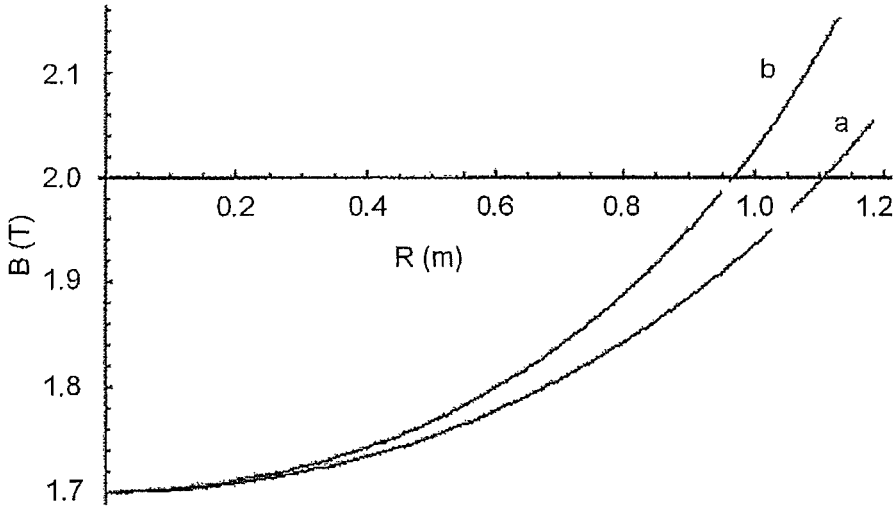
FIG. 5 is a diagram showing another example of the magnetic field distribution in the circular accelerator according to Embodiment 1 of the invention.

FIG. 5 shows another example of the radial average magnetic flux density distribution necessary for accelerating protons to 230 MeV. The horizontal axis represents the radius R(m); the vertical axis, the bending magnetic field intensity (magnetic flux density) B(T). The curve represented by a in FIG. 5 is an example of the magnetic field distribution of the present invention, which is the magnetic field distribution when x=0.8 in the equation (1). In FIG. 5, the typical magnetic field distribution of the conventional cyclotron as described in Patent Document 2, etc. is represented by the curve b for comparison.

Figure 6:
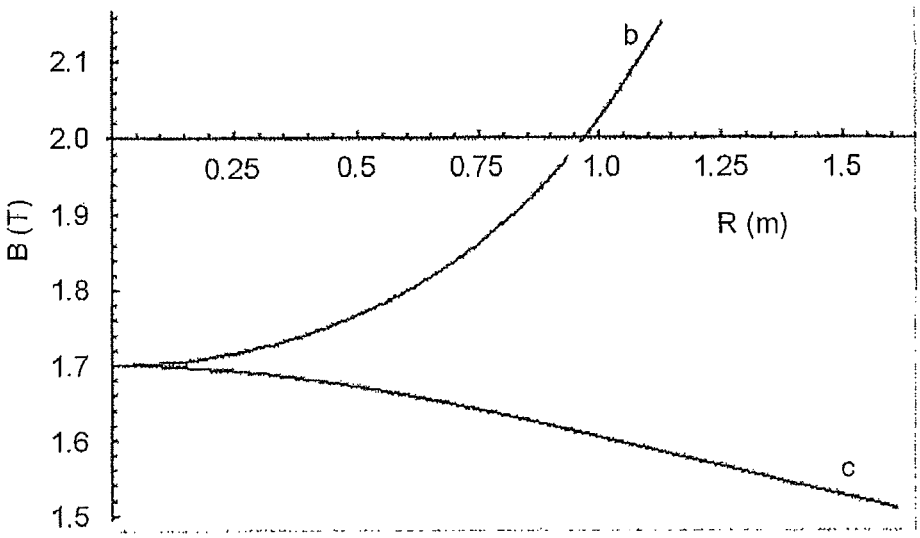
FIG. 6 is a diagram showing an example of magnetic field distribution in a conventional circular accelerator.

In FIG. 6 are shown for reference the typical magnetic field distribution of the conventional cyclotron in Patent Document 2, etc. and that of a conventional synchrocyclotron in Patent Document 1, etc. FIG. 6 shows the radial average magnetic flux density distribution necessary for accelerating protons to 230 MeV; the curve b in the figure represents the magnetic field distribution of the conventional cyclotron in Patent Document 2, etc., which is the same magnetic field distribution as the curve b in FIG. 4 and FIG. 5; and the curve c in the figure represents the typical magnetic field distribution of the conventional syncrocyclotron in Patent Document 1, etc.

As will be appreciated from FIG. 4 to FIG. 6, the magnetic field distribution of the bending magnetic field in the circular accelerator of the present invention is made to be intermediate one between the typical magnetic field distribution of the conventional cyclotron and that of the conventional syncrocyclotron. The magnetic field distribution of the present invention does not necessarily need to be the one that satisfies the equation (1) over the whole region of generation to extraction of the charged particles, that is, over the whole radius range. Since portions in which the charged particles are generated and extracted come to the center and end portion of the magnet, respectively, the distribution may deviate slightly from the equation (1) at these positions. If the portion in which the magnetic field distribution deviates from the equation (1) expands over 20% of the whole radius range, acceleration efficiency will be reduced; therefore it needs to be controlled below 20%.

Figure 7:
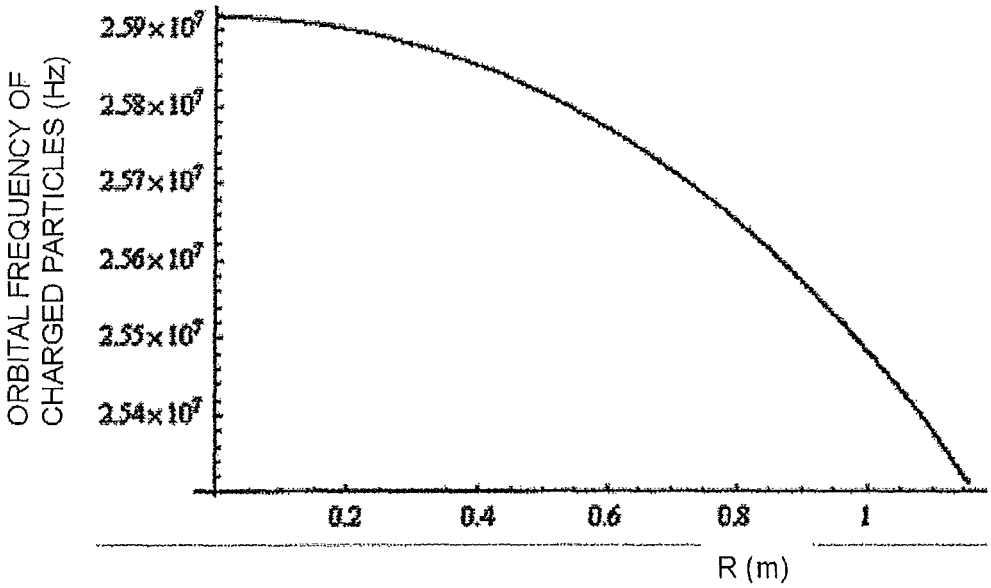
FIG. 7 is a diagram showing an example of radius dependence of an orbital frequency of charged particles in the circular accelerator according to Embodiment 1 of the invention.

In FIG. 7 is shown radius dependence of the orbital frequency of charged particles when protons are accelerated to 230 MeV by the circular accelerator of the present invention that has the magnetic field distribution represented by the curve a in FIG. 4. In FIG. 7, the horizontal axis represents the radius R(m); the vertical axis, the orbital frequency (Hz) of charged particles. The orbital frequency of the charged particles varies 0.6 MHz from 25.9 MHz at the injection portion to around 25.3 MHz at the extraction portion, that is, approximately 2% with respect to the frequency at the extraction portion. The frequency of a radio-frequency wave supplied from the radio-frequency power source 120 is varied in accordance with this variation. Even if the frequency of the radio-frequency wave supplied from the radio-frequency power source 120 is varied, if the variation is within this amount and if the resonant sharpness of an acceleration electrode portion (Q-factor: center frequency f/half-power bandwidth Δf) is less than 100, preferably some 50, acceleration to 230 MeV can be achieved with the resonant frequency of the acceleration electrode portion not varied but kept constant, using a radio-frequency power source with a capacity of some 10 kW. In the example shown in FIG. 7, the resonant frequency of the acceleration electrode portion may be set to the median value of 25.6 MHz between the orbital frequency of the charged particles at the injection portion, 25.9 MHz, and the orbital frequency thereof at the extraction portion, 25.3 MHz. Here, the resonant frequency of the acceleration electrode portion means the resonant frequency of the entire load including the acceleration electrode 105, the acceleration-electrode-opposing ground plate 106, the acceleration gap 113, the acceleration-electrode extension electrode 107, and the radio-frequency electromagnetic field coupling part 108, viewed from the input end of the radio-frequency electromagnetic field coupling part 108.

As described above, the resonant sharpness (Q-factor) of the acceleration electrode portion is reduced, and even if the frequency of the radio-frequency wave supplied from the radio-frequency power source 120 varies, a predetermined acceleration electric field is applied across the acceleration electrode 105 and the acceleration-electrode-opposing ground plate 106 without varying the resonant frequency of the acceleration electrode portion. Reduction in the Q-factor can be actually realized by roughening the metal (usually copper) surface of the entire acceleration electrode. However, in order to suppress heat generation in the entire acceleration electrode, the configuration as shown in FIG. 1 is adopted in this Embodiment 1, in which a radio-frequency power consumption load 111 is attached to the radio-frequency electromagnetic field coupling part 108, and radio-frequency power is consumed in the radio-frequency power consumption load, thereby reducing the Q-factor.

Figure 8:
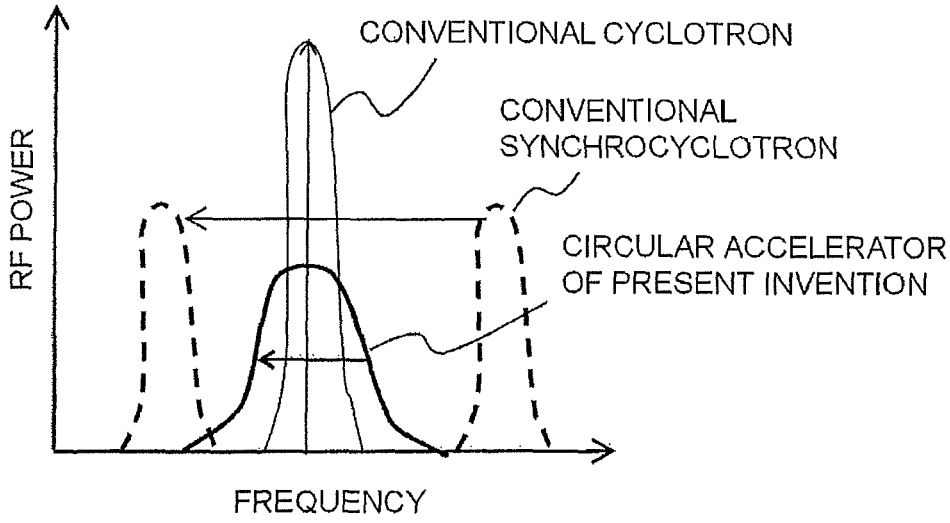
FIG. 8 is a view conceptually expressing difference in radio-frequency operations of the present invention, a conventional cyclotron and a conventional synchrocyclotron.

FIG. 8 is a view conceptually expressing difference among radio-frequency operations of the present invention, the conventional cyclotron and conventional synchrocyclotron. In the figure, the horizontal axis represents frequency; the vertical axis, radio-frequency power that can be applied to the acceleration electrode. That is to say, curves in FIG. 8 represent the resonant characteristics of the respective acceleration electrode portions: the bold solid-line curve represents the resonant characteristics of the acceleration electrode portion of the present invention; the fine solid-line curve, those of the acceleration electrode portion of the conventional cyclotron; and the dashed-line curve, those of the acceleration electrode portion of the conventional syncrocyclotron. Moreover, arrows each represent an image of frequency variation in a radio frequency wave to be supplied. In the conventional cyclotron, the resonant characteristics of the acceleration electrode portion are sharp (Q-factor is large), and the frequency of the radio-frequency wave to be supplied is constant. Moreover, in the conventional syncrocyclotron, the frequency of the radio-frequency wave to be supplied is varied during acceleration, and in addition, the resonant frequency of the acceleration electrode portion is also varied in accordance with the variation. In contrast to those, although the frequency of the radio-frequency wave to be supplied is slightly varied during acceleration in the circular accelerator of the present invention, its variation rate is smaller compared to the conventional syncrocyclotron. Therefore, the Q-factor of the resonant characteristics of the acceleration electrode portion is reduced so that the variation in the frequency of the radio-frequency wave to be supplied becomes less than half-power bandwidth of the resonant characteristics, for example, and an acceleration electric field is applied in this state to the acceleration gap without varying the resonant frequency of the acceleration electrode portion.

Figure 9:
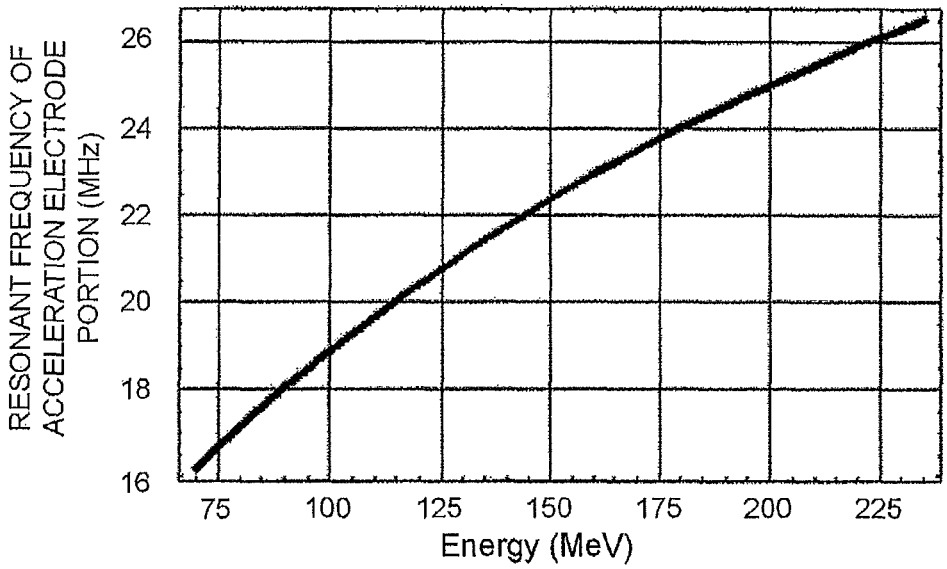
FIG. 9 is a diagram showing an example of a relationship between the resonant frequency of an acceleration electrode portion of the circular accelerator according to Embodiment 1 of the invention and extraction proton energy to be obtained at the frequency.

In this invention, energy of the extraction charged particles can be varied by changing the resonant frequency of the acceleration electrode portion and greatly varying the radio-frequency wave supplied from the radio-frequency power source 120 when the charged particles are not accelerated, that is, in a preparation stage of the accelerator. FIG. 9 shows a relationship between the resonant frequency of the acceleration electrode portion and energy of extraction protons. In FIG. 9, the horizontal axis represents the energy of the extraction protons (MeV); the vertical axis, the resonant frequency (MHz). The resonant frequency may be set to around 16 MHz when protons are extracted with energy of 70 MeV, and around 26 MHz when extracted with energy of 230 MeV.

As shown in FIG. 1 and FIG. 2, the acceleration-electrode extension electrode 107 connected to the acceleration electrode 105 is connected to the radio-frequency electromagnetic field coupling part 108. When energy of extraction charged particles is changed, capacitance or inductance of the radio-frequency electromagnetic field coupling part 108 is changed by shifting in the arrow direction a tuner 109 provided in the radio-frequency electromagnetic field coupling part 108, when the charged particles are not accelerated. The resonant frequency of the acceleration electrode portion is changed in this way. Incidentally, although a tuner 119 in FIG. 2 and the tuner 109 in FIG. 1 differ from each other in shape, they work in the same way, that is, they work to vary the capacitance or inductance of the radio-frequency electromagnetic field coupling part 108. When the extraction energy is changed, the tuner 109 or tuner 119 may be slowly shifted when the charged particles are not accelerated, so that a predetermined resonant frequency can be easily realized.

When accelerating energy of the charged particles is varied, the magnetic field intensity and magnetic field distribution by the bending electromagnet need to be changed. The magnetic field distribution is shaped by adjusting currents flowing through the exciting coil 104 and a coil for modifying a magnetic field 202 shown in FIG. 2. That is to say, the magnetic field distribution is shaped by adding a magnetic field generated by the current flowing through the coil for modifying a magnetic field 202 to that formed in the magnetic gap by the exciting coil 104 and the electromagnet return yoke 101. The magnetic field added thereto by the coil for modifying a magnetic field 202 is sometimes in the opposite direction of that of the magnetic field formed in the magnetic gap by the exciting coil 104 and the electromagnet return yoke 101, in which case the magnetic field is reduced.

Figure 10:
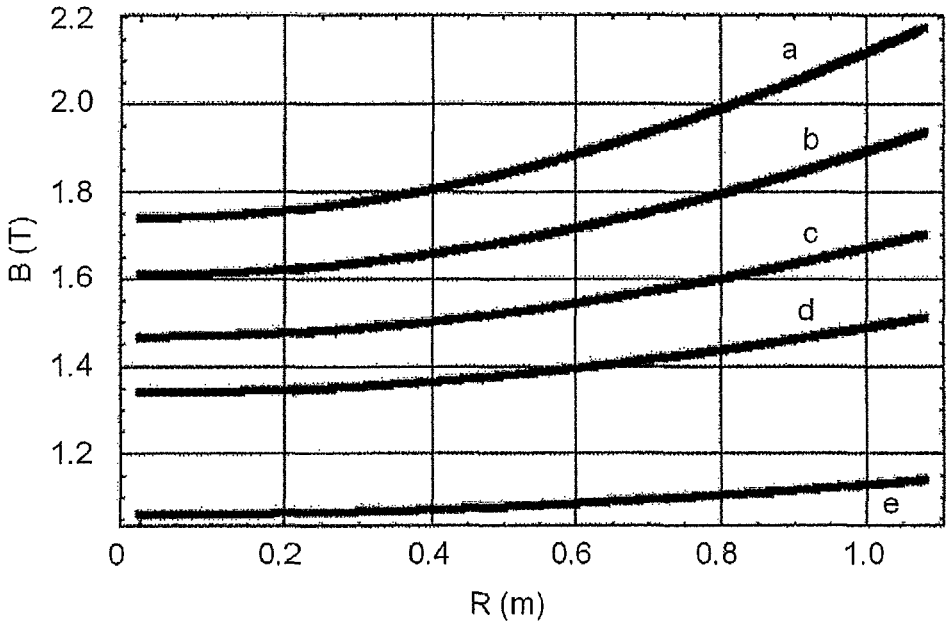
FIG. 10 is a diagram showing an example of the magnetic field distribution in the circular accelerator according to Embodiment 1 of the invention, using the extraction proton energy as a parameter.

In FIG. 10 is shown the average radial magnetic flux density distribution of the bending magnetic field when the extraction protons have different quantities of energy. In FIG. 10, the horizontal axis represents the radius R(m); the vertical axis, the magnetic flux density B(T). Symbols a, b, c, d and e represent magnetic field distribution when the extraction energy is 235 MeV, 190 MeV, 150 MeV, 120 MeV, and 70 MeV, respectively. Shaping of the magnetic field of the average magnetic flux density is performed by varying the exciting currents through the exciting coil 104 and the coil for modifying a magnetic field 202.

Figure 11:
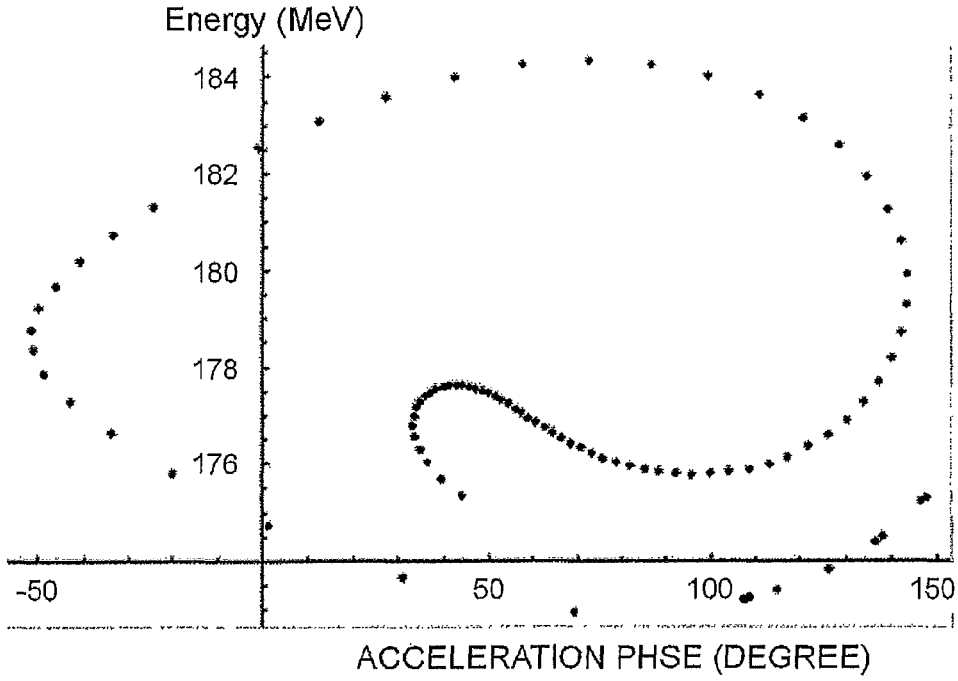
FIG. 11 is a view showing an example of a beam-orbit analysis result when protons are accelerated by the circular accelerator according to Embodiment 1 of the invention.

In FIG. 11 is shown an example of a beam orbit analysis of protons accelerated to 180 MeV by the circular accelerator of the present invention. The horizontal axis represents the acceleration phase (degree); the vertical axis, energy (MeV). That shows a result of a beam orbit analysis on how the protons are accelerated in a radio-frequency electric field and orbital magnetic field after they have been generated from the ion source 110 with energy of 30 keV. The magnetic field distribution is computed with x=0.92. It can be appreciated from the figure that the protons are stably accelerated while forming quite a large stable region in a vertical direction. Particles accelerated to higher energy reach the extraction duct 112 in series, and are taken out of the accelerator.

Figure 12:
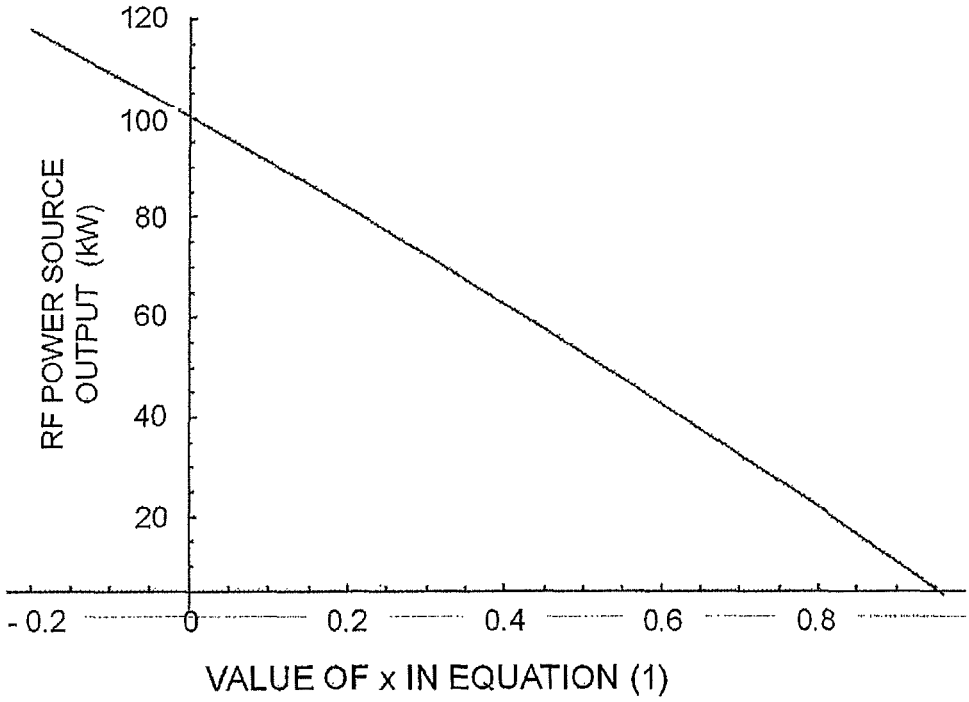
FIG. 12 is a diagram showing an example of radio-frequency power source output necessary for the circular accelerator according to Embodiment 1 of the invention.

In FIG. 12 is shown radio-frequency power source output (kW) necessary for exciting the acceleration electrode when the magnetic field distribution in the acceleration region, that is, x of the average magnetic flux density expressed by the equation (1), is varied. In FIG. 12, the horizontal axis represents the value of x in the equation (1); the vertical axis, the radio-frequency power source output (kW). As seen from the figure, the closer the value of x to 1, the less the radio-frequency power source output required. On the other hand, the same computation as in FIG. 11 indicates that when $x>0.98$, charged particles cannot be stably accelerated, affected by an electromagnetic field error attributed to the bending electromagnet. Moreover, when $x<-0.2$, that is, when the value of the radio-frequency power exceeds 120 kW, heat generation in the acceleration electrode become high when the resonant Q-factor is reduced, which makes it difficult to cool the electrode in a usual way. In conclusion, the value of x would preferably be $-0.2<x<0.97$. If this condition is replaced with variation in the orbital frequency of the charged particles, $\Delta f$, the following inequality is obtained with respect to the orbital frequency $f_0$ at the extraction portion of the charged particles:

$$0.007\times f_0<\Delta f<0.247\times f_0$$

That is to say, the magnetic field distribution of the bending magnetic field of the present invention is a magnetic field in which the orbital frequency of the charged particles varies from 0.7% to 24.7% with respect to the orbital frequency of the charged particles at the extraction portion, during a time of injection to extraction of the charged particles. Conversely, this means that the magnetic field distribution of the present invention is set to magnetic field distribution such that variation in the orbital frequency of the charged particles as described above is induced, or the charged particles can be accelerated by varying the frequency of the radio-frequency wave to be supplied as described above.

Incidentally, the ion source 110 is disposed at the injection position of the circular accelerator so as to generate charged particles in the example of FIG. 1; however, if the charged particles are generated outside the circular accelerator and then injected into the accelerator through an injection electrode disposed at the same position as the ion source 110 (generally referred to as external injection), the same effects can be brought about.

Moreover, radio-frequency power is consumed in the radio-frequency power consumption load 111 so as to reduce the Q-factor in the example of FIG. 1; however, the Q-factor may be reduced by providing a radio-frequency power extraction part, such as a coupler, at the position of the radio-frequency power consumption load 111, then extracting the radio-frequency power, and consuming it outside the accelerator.

As described above, in the magnetic field distribution in the circular accelerator according to Embodiment 1 of the present invention, x in the equation (1) is made to be a value excluding 1, that is, the magnetic field distribution is made to be the one between the typical magnetic field distribution of the conventional syncrocyclotron and that of the conventional cyclotron. However, the magnetic field distribution does not need to exactly follow the equation (1), but it may deviate in part from the equation (1) in around 20% of the whole radius range. This magnetic field distribution of the bending magnetic field is such a magnetic field as the orbital frequency of the charged particles varies within a variation range of 0.7% to 24.7% with respect to the orbital frequency of the charged particles at the extraction portion, during a time of injection to extraction of the charged particles. Moreover, the Q-factor in the resonant characteristics of the acceleration electrode portion is reduced, and even if the frequency of radio-frequency wave to be supplied varies, an acceleration electric field is applied to the acceleration gap without varying the resonant frequency of the acceleration electrode portion. The Q-factor is preferably reduced to less than 100, and the variation in the frequency of the radio-frequency wave to be supplied is made less than half-power bandwidth of the resonant characteristics of the acceleration electrode portion. Excessive reduction in the Q-factor in the resonant characteristics increases radio-frequency losses too much.

The foregoing configuration brings about effects in which not only acceleration energy can be varied by one accelerator, but also the resonant frequency of the acceleration electrode portion does not need to be varied during acceleration, resulting in the accelerator being highly reliable, accuracy required for the magnetic field by the electromagnet only has to be some $2\times10^{-3}$, and the magnetic poles do not need to be reworked after assembled.

Embodiment 2

Figure 13:
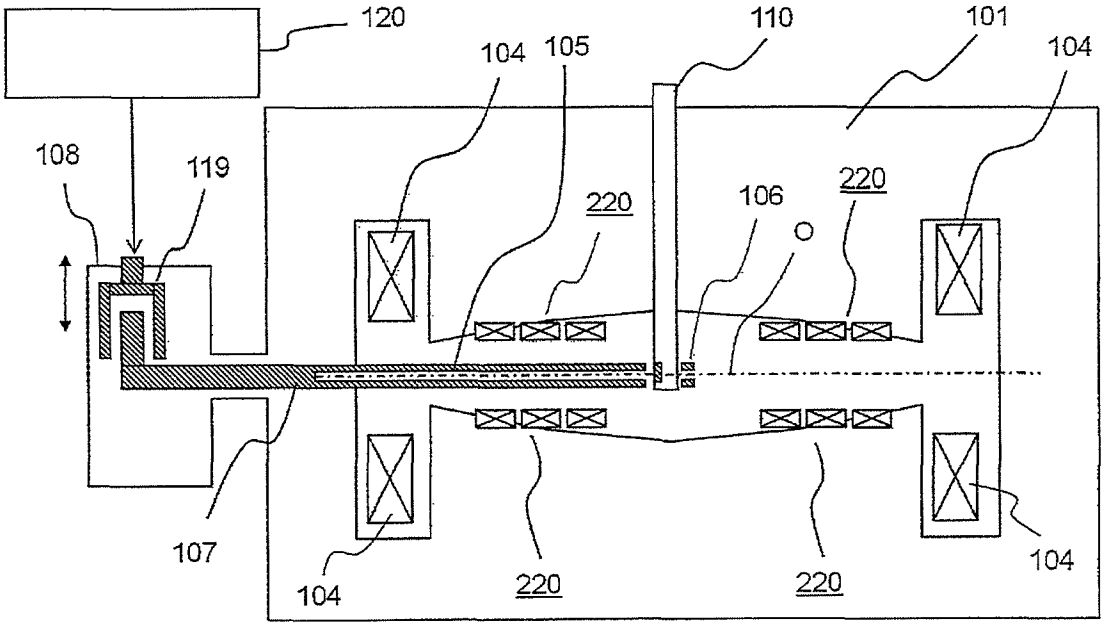
FIG. 13 is a schematic side cross-sectional view showing a general configuration of a circular accelerator according to Embodiment 2 of the invention.
Figure 14:
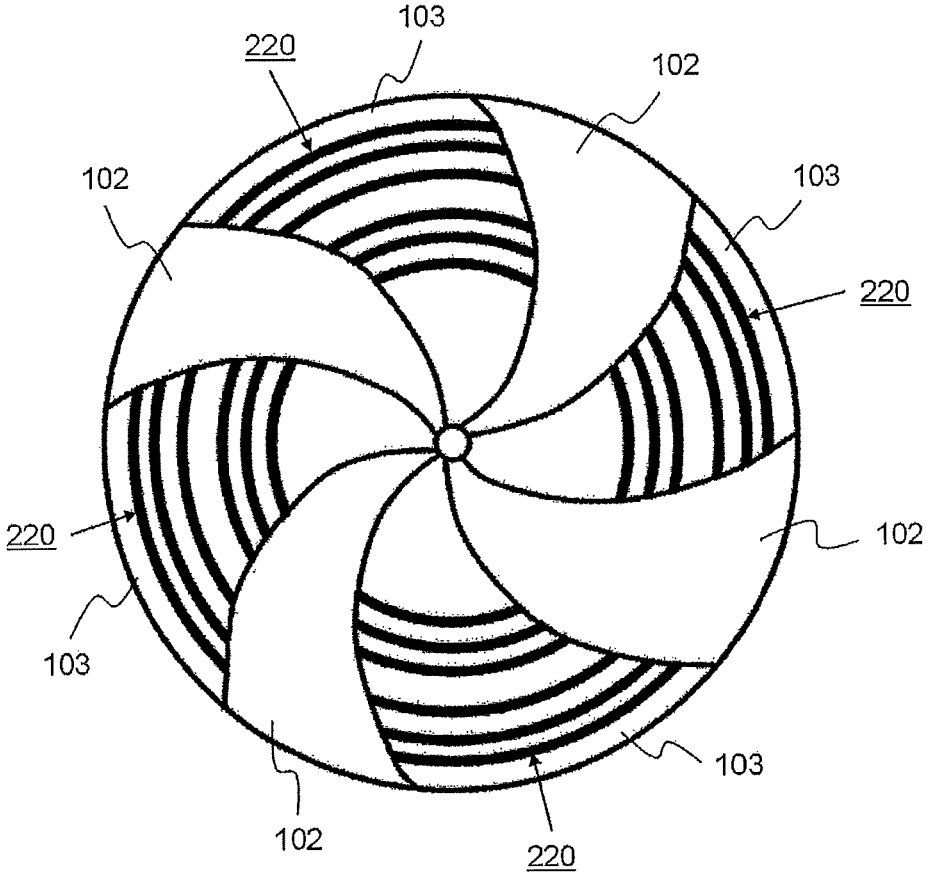
FIG. 14 is a diagram showing an example of disposing coils for modifying a magnetic field of the circular accelerator according to Embodiment 2 of the invention.

FIG. 13 is a schematic side cross-sectional view showing a general configuration of a circular accelerator according to Embodiment 2 of the present invention, which corresponds to FIG. 2 of Embodiment 1. In FIG. 13, the same reference numerals as those in FIG. 1 and FIG. 2 show the same or corresponding parts. In this Embodiment 2, a plurality of coils for modifying a magnetic field 220 is disposed along the magnetic pole plane as shown in FIG. 13, and the coils are excited so as to generate a stronger magnetic field toward the outer side. An example of more specific disposal of the coils for modifying a magnetic field 220 is shown in FIG. 14. FIG. 14 is a view in which the magnetic pole plane of the electromagnet return yoke 101, that is, the portion where the electromagnet hills 103 and electromagnet valleys 102 are alternately repeated, is viewed from the orbital plane. The coils for modifying a magnetic field 220 are disposed on the magnetic pole faces of the electromagnet hills 103 so that currents flow at least circumferentially. The magnetic field distribution is shaped by adding a magnetic field generated by the currents flowing through the coils for modifying a magnetic field 220 to that formed in the magnetic gap by the exciting coil 104 and electromagnet return yoke 101. A higher current is made to flow through a coil closer to the outer side, coil density is increased toward the outer side or so forth, whereby the magnetic field is made stronger toward the outer side. The coil for modifying a magnetic field 202 is provided at just one location in Embodiment 1; however in Embodiment 2, the plurality of coils for modifying a magnetic field 220 are provided as described above, and the coils are excited so that the magnetic field becomes stronger toward the outer side.

Figure 15:
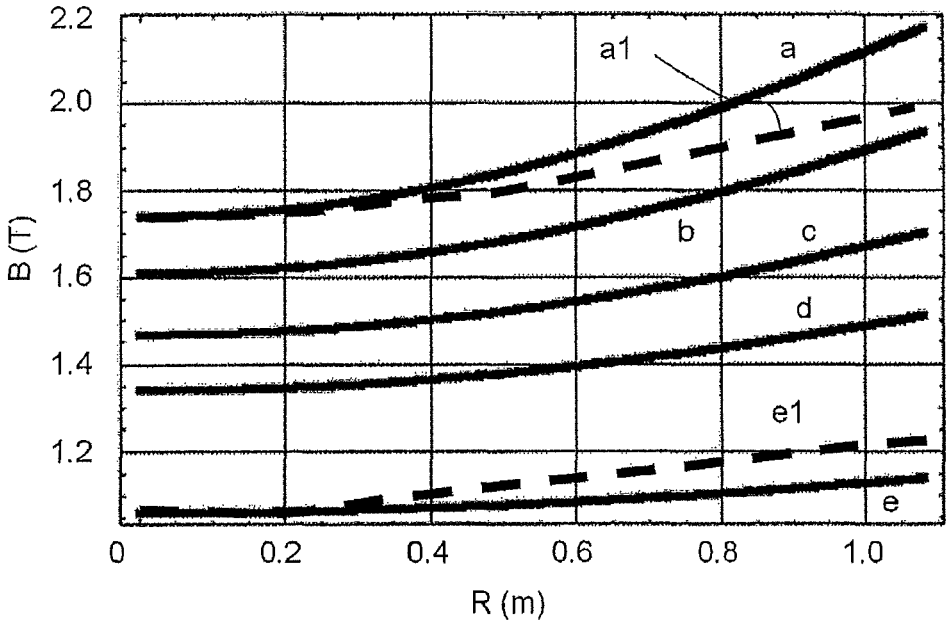
FIG. 15 is a diagram showing an example of magnetic field distribution for explaining the operation of the coils for modifying a magnetic field in the circular accelerator according to Embodiment 2 of the invention.

Next, the operation of the coils for modifying a magnetic field 220 will be described referring to FIG. 15. FIG. 15 shows, the same as the foregoing FIG. 10, the radial average magnetic flux density distribution of the bending magnetic field when extraction protons have different energy from each other. Symbols a, b, c, d and e represent magnetic field distribution when the extraction energy is 235 MeV, 190 MeV, 150 MeV, 120 MeV and 70 MeV, respectively. For example, the average magnetic flux density distribution of the bending magnetic field that corresponds to 150 MeV and is represented by the curve c in FIG. 15 is generated by the magnetic gap and exciting coil 104. When energy is changed up to 235 MeV afterward, the magnetomotive force of the exciting coil 104 is increased. However it is conceivable that the average magnetic flux density distribution of the bending magnetic field represented by the dashed line al in FIG. 15 can only be obtained. In this case, the predetermined distribution represented by the curve a, that is, the magnet field distribution for obtaining the energy of 235 MeV cannot be obtained. So, a correction magnetic field generated by the coils for modifying the magnetic field 220 is added, whereby the current magnetic field distribution al is changed to the magnet field distribution a, so that magnet field distribution capable of accelerating to the extraction energy of 235 MeV can be obtained. Moreover, when the energy is changed down to 70 MeV, the coil magnetomotive force is decreased. However it is conceivable that the average magnetic flux density distribution of the bending magnetic field represented by the dashed line e1 of FIG. 15 can only be obtained by that. In this case, predetermined magnetic field distribution represented by the curve e cannot be obtained. So, a negative correction magnetic field, that is, a magnetic field in the opposite direction is generated by the coils for modifying a magnetic field 220, whereby the current magnetic field distribution e1 is changed to the magnet field distribution e, so that magnet field distribution capable of accelerating to the extraction energy of 75 MeV can be obtained.

Figure 16:
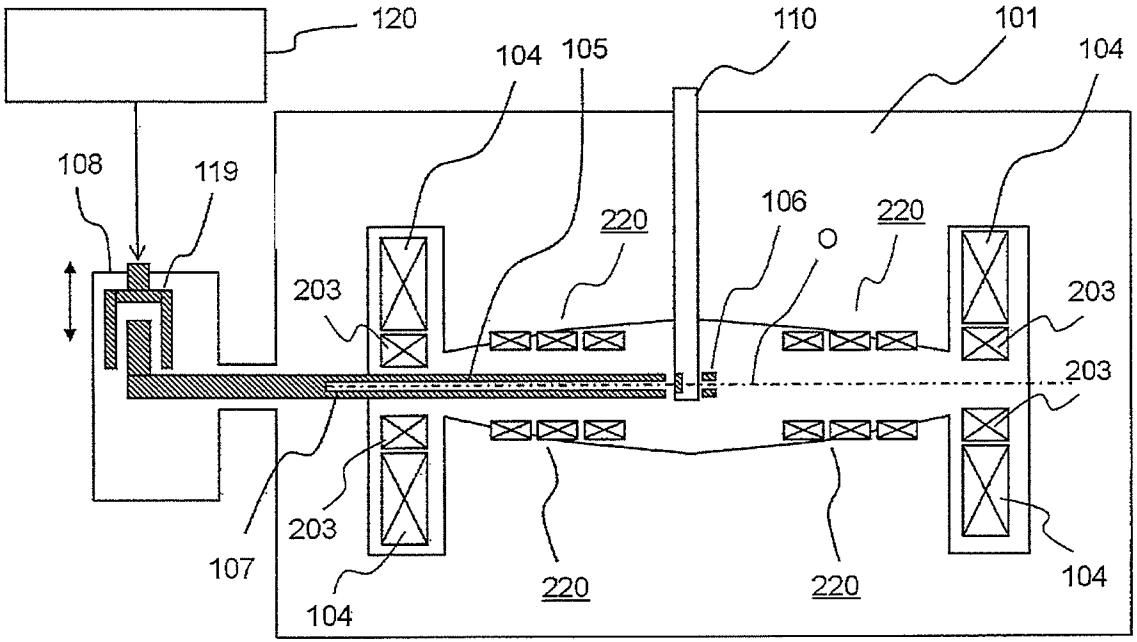
FIG. 16 is a schematic side cross-sectional view showing another general configuration of the circular accelerator according to Embodiment 2 of the invention.

FIG. 16 is a schematic side cross-sectional view showing another general configuration of the circular accelerator according to Embodiment 2 of the invention. In FIG. 16, the same reference numerals as those in FIG. 13 show the same or corresponding parts. It is also conceivable that a steep magnet field gradient in the outermost circumference cannot be realized only by the coils for modifying a magnetic field 220 provided on the electromagnet hills 103 as shown in FIG. 14, particularly in such a case as the electromagnet return yoke 101 is magnetically saturated. In this case, the exciting coil 104 is split into the exciting coil 104 and a coil for modifying a magnetic field 203 as shown in FIG. 16, that is, the coil for modifying a magnetic field 203 is disposed at the same radial position as the exciting coil 104. In a region where the electromagnet return yoke 101 is magnetically saturated, a modifying magnetic field is generated by the coil for modifying a magnetic field 203, so as to enable the steep magnet field gradient to be realized in the outermost circumference.

According to the present invention as described above, since accuracy required for the magnetic field by the electromagnet only has to be some $2\times10^{-3}$, various configurations, such as disposing at optimum positions coils including the coils for modifying a magnetic field 220 and coil for modifying a magnetic field 203, can be adopted as the configuration for generating a magnetic field. Moreover, this can also bring about an effect of eliminating readjustment of the magnetic field such as reworking the magnetic poles after assembled, which has been necessary in the conventional cyclotron.

Embodiment 3

Figure 17:
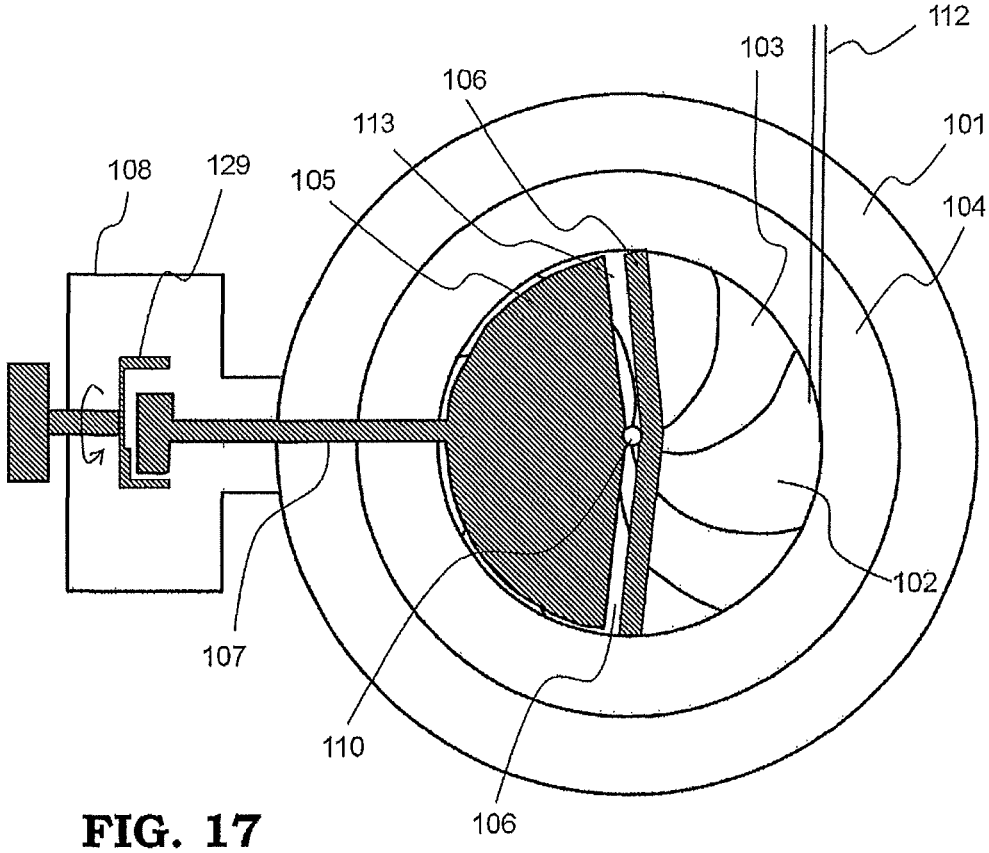
FIG. 17 is a schematic cross-sectional view showing a general configuration of a circular accelerator according to Embodiment 3 of the invention.

FIG. 17 is a schematic cross-sectional view showing a general configuration of a circular accelerator according to Embodiment 3 of the present invention, which corresponds to FIG. 1 of Embodiment 1. In FIG. 17, the same reference numerals as those in FIG. 1 and FIG. 2 show the same or corresponding parts. The circular accelerator according to this Embodiment 3 differs from that in FIG. 1 in the configuration of the tuner of the radio-frequency electromagnetic field coupling part 108; the tuner of this Embodiment is made up of a rotatable condenser 129. The electrode of the rotatable condenser 129 is rotated, and thereby its capacitance is changed, so that the resonant frequency of the acceleration electrode portion is changed. In the circular accelerator of the present invention, the resonant frequency of the acceleration electrode portion is changed when energy is changed, and not changed during acceleration of charged particles. Therefore, the rotatable condenser 129 may be slowly rotated in a few seconds, and the resonant frequency does not need to be changed at as high speed as 1 kHz during acceleration of charged particles, as has been needed in the conventional syncrocyclotron, so that a highly reliable system can be realized.

Embodiment 4

Figure 18:
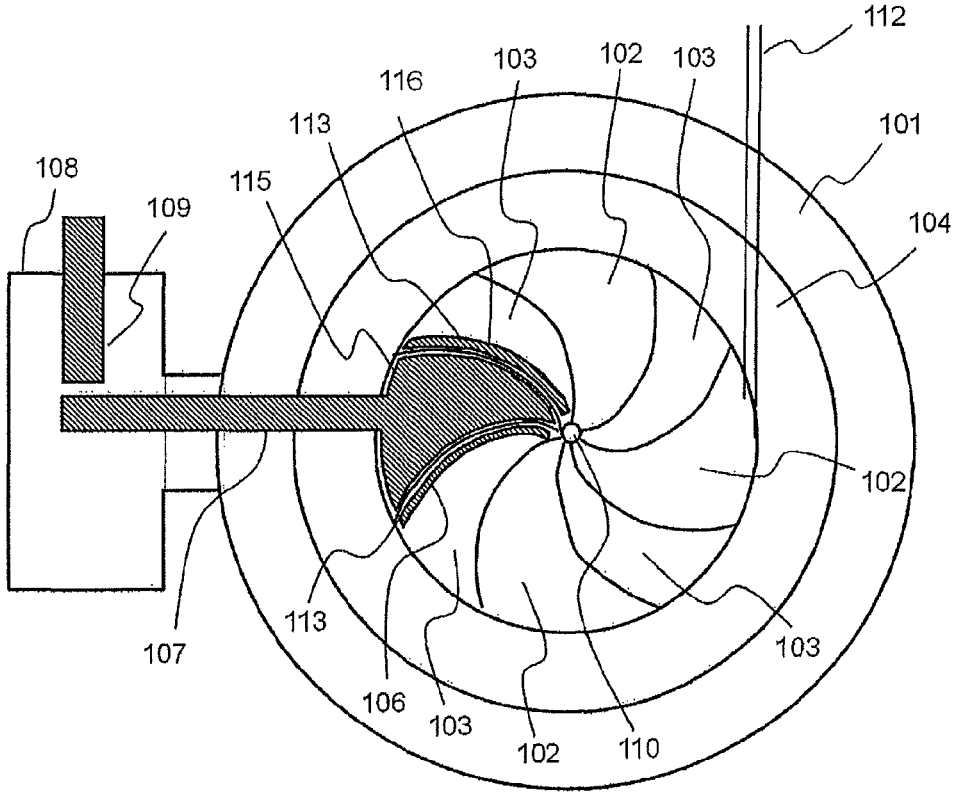
FIG. 18 is a schematic cross-sectional view showing a general configuration of a circular accelerator according to Embodiment 4 of the invention.

FIG. 18 is a schematic cross-sectional view showing a general configuration of a circular accelerator according to Embodiment 4 of the present invention, which corresponds to FIG. 1 of Embodiment 1. In FIG. 18, the same reference numerals as those in FIG. 1 and FIG. 2 show the same or corresponding parts. The circular accelerator according to this Embodiment 4 differs from that in FIG. 1 in the configuration of the acceleration electrode; in this Embodiment, an acceleration electrode 115 is provided only on part of one of the electromagnet valleys 102 (portion where the magnetic pole gap is wide) as shown in FIG. 18. In this case, in order to obtain a phase of a radio-frequency electric field that enables charged particles to be accelerated at acceleration gaps 113 in both sides of the acceleration electrode 115, the frequency of the radio-frequency wave to be supplied may be increased N (integer not less than 2) times as high as that in the case of using the acceleration electrode configured as shown in FIG. 1, etc. By configuring as described above, the magnetic pole gap of the electromagnet hills 103 (portion where magnetic pole gap is narrow) can be narrowed while securing the space for disposing the acceleration electrode 115; therefore an effect can be brought about in which strong beam converging force can be secured in a direction perpendicular to the beam, thereby enabling stable beam acceleration.

Various modifications and alterations of this invention will be apparent to those skilled in the art without departing from the scope and spirit of this invention, and it should be understood that this is not limited to the illustrative embodiments set forth herein.

What is claimed is:

1. A circular accelerator that accelerates charged particles injected into the center thereof by a radio-frequency electric field while making the particles orbit along a spiral orbit by a bending magnetic field, the circular accelerator comprising:

a bending electromagnet that is excited by an exciting coil and thereby generates the bending magnetic field, the bending electromagnet including an electromagnet hill for forming a narrow magnetic pole gap and an electromagnet valley for forming a wide magnetic pole gap alternately disposed in an orbiting direction of the charged particles;

a radio-frequency power source that generates the radio-frequency electric field in accordance with an orbital frequency of the charged particles;

a radio-frequency electromagnetic field coupling part connected to the radio-frequency power source;

an acceleration electrode connected to the radio-frequency electromagnetic field coupling part; and an acceleration-electrode-opposing ground plate provided to form an acceleration gap between the plate itself and the acceleration electrode, for generating the radio-frequency electromagnetic field in the orbing direction of the charged particles; wherein the bending electromagnet generates the bending magnetic field varying in such a way that the orbital frequency of the charged particles varies in a variation range of 0.7% to 24.7% with respect to an orbital frequency at the charged-particles' extraction portion, during a time of injection to extraction of the particles.

2. A circular accelerator according to claim 1, wherein average magnetic flux density B(r) in the orbiting direction of the charged particles and total energy of the particles E(r) in a position with a radius r can be expressed using average magnetic flux density $B_O$ at a radius corresponding to an extraction position of the charged particles and energy $E_O$ of the particles in the extraction position as follows:

$$B(r)=(B_O/E_O^x)\times E(r)^x$$

in which relationship, the bending electromagnet generates magnetic flux density distribution with x being a constant excluding 1.

3. A circular accelerator according to claim 2, wherein the above x is $-0.2<x<0.97$.

4. A circular accelerator according to claim 1, wherein a frequency of a radio-frequency wave supplied from the radio-frequency power source is varied in accordance with variation in the orbital frequency of the charged particles.

5. A circular accelerator according to claim 4, wherein a Q-factor in resonant characteristics of an acceleration electrode portion, which is resonant characteristics of an entire load viewed from an input end of the radio-frequency electromagnetic field coupling part, is less than 100.

6. A circular accelerator according to claim 5, wherein the variation in the orbital frequency of the charged particles is within half-power bandwidth of the resonant characteristics of the acceleration electrode portion.

7. A circular accelerator according to claim 1, further comprising a unit that changes a resonant frequency of an acceleration electrode portion, which is a resonant frequency of the entire load viewed from an input end of the radio-frequency electromagnetic field coupling part.

8. A circular accelerator according to claim 7, wherein the radio-frequency electromagnetic field coupling part includes a unit that changes inductance or capacitance.

9. A circular accelerator according to claim 1, further comprising a unit that modifies radial magnetic flux density distribution of the bending magnetic field.

10. A circular accelerator according to claim 9, further comprising a plurality of coils for modifying a magnetic field that is disposed radially and modifies the radial magnetic flux density distribution of the bending magnetic field.

11. A circular accelerator according to claim 10, wherein the plurality of coils for modifying a magnetic field is provided in a position of the electromagnet hill.

12. A circular accelerator according to claim 9, wherein a coil for modifying a magnetic field, that modifies the radial magnetic flux density distribution of the bending magnetic field is provided in the same radial position as the exciting coil.

13. A circular accelerator according to claim 1, wherein the acceleration electrode is disposed in a position corresponding to the electromagnet valley.

14. A method of operating a circular accelerator according claim 9, wherein the radial magnetic flux density distribution of the bending magnetic field is modified while a radio-frequency wave is not supplied from the radio-frequency power source, and in addition, a resonant frequency of the acceleration electrode position, which is a resonant frequency of an entire load viewed from an input end of the radio-frequency electromagnetic field coupling part, is changed.

15. A method of operating the circular accelerator according to claim 14, wherein the resonant frequency of the acceleration electrode portion is changed by changing inductance or capacitance of the radio-frequency electromagnetic field coupling part.

16. A circular accelerator according to claim 1, wherein the electromagnetic valleys are comprised of an electromagnet that is thinner than an electromagnet of the electromagnetic hills.

17. A circular accelerator that accelerates charged particles injected into the center thereof by a radio-frequency electric field while making the particles orbit along a spiral orbit by a bending magnetic field, the circular accelerator comprising:

a bending electromagnet that is excited by an exciting coil and thereby generates the bending magnetic field, the bending electromagnet including an electromagnet hill for forming a narrow magnetic pole gap and an electromagnet valley for forming a wide magnetic pole gap alternately disposed in an orbiting directing of the charged particles;

a radio-frequency power source that generates the radio-frequency electric field in accordance with an orbital frequency of the charged particles;

a radio-frequency electromagnetic field coupling part connected to the radio-frequency power source;

an acceleration electrode connected to the radio-frequency electromagnetic field coupling part; and an acceleration-electrode-opposing ground plate provided to form an acceleration gap between the plate itself and the acceleration electrode, for generating the radio-frequency electromagnetic field in the orbiting direction of the charged particles; wherein average magnetic flux density B(r) in the orbiting direction of the charged particles and total energy of the particles E(r) in a position with a radius r can be expressed using average magnetic flux density $B_O$ at a radius corresponding to an extraction position of the charged particles and energy $E_O$ of the particles in the extraction position as follows:

$$B(r)=(B_O/E_O^x)\times E(r)^x$$

in which relationship, the bending electromagnet generates magnetic flux density distribution with x being a constant excluding 1.

18. A circular accelerator according to claim 17, wherein the electromagnetic valleys are comprised of an electromagnet that is thinner than an electromagnet of the electromagnetic hills.

19. A circular accelerator according to claim 17, wherein the x is $-0.2<x<0.97$.

* * * * *